United States Patent [19]

Grace, Jr. et al.

[11] 4,006,680

[45] Feb. 8, 1977

[54] TYPE CARRIER BELT FOR A PRINTER

[76] Inventors: Louis Grace, Jr., 34795 Pratt Road; Richard L. Grace, 81630 Belle River Road, both of Memphis, Mich. 48041

[22] Filed: Mar. 19, 1976

[21] Appl. No.: 668,353

[52] U.S. Cl. ..... 101/93.14; 101/111

[51] Int. Cl.[2] ..... B41J 1/20

[58] Field of Search ..... 101/93.13, 93.14, 105, 101/111

[56] References Cited

UNITED STATES PATENTS

| | | | |
|---|---|---|---|
| 3,399,619 | 9/1968 | Sims | 101/93.14 |
| 3,499,382 | 3/1970 | Potter et al. | 101/93.14 |
| 3,633,501 | 1/1972 | Edwards et al. | 101/111 |
| 3,791,292 | 2/1974 | Soderstrom et al. | 101/111 |
| 3,942,437 | 3/1976 | Hatsuse | 101/111 |
| 3,949,665 | 4/1976 | Perry | 101/111 |

OTHER PUBLICATIONS

Bastwick, "Pointer Chain," IBM Technical Disclosure Bulletin, vol. 9, No. 9, Feb. 1967, p. 1204.

*Primary Examiner*—Edward M. Coven
*Attorney, Agent, or Firm*—Cullen, Settle, Sloman & Cantor

[57] ABSTRACT

A type carrier belt formed into an endless loop comprising at least one elastomeric band having a trapezoidal cross-section and a plurality of interchangeable type segments snap-fitted onto the band in a side-by-side manner. Each of the segments has a flat back surface forming the radially inner surface of the belt loop, tapered leading and trailing edge portions adapted to enable said belt loop to be rotatably driven, and an indicia-bearing outer peripheral portion. The outer portion includes at least two raised pedestal portions each having an outer surface parallel to the back surface and adapted to position an indicia thereon and a dove tail-shaped slot disposed between the pedestal portions for receivably retaining the band therein. The indicia may be adapted to form alpha-numeric characters or to act as timing marks or both types may be employed on the different pedestals if desired.

37 Claims, 9 Drawing Figures

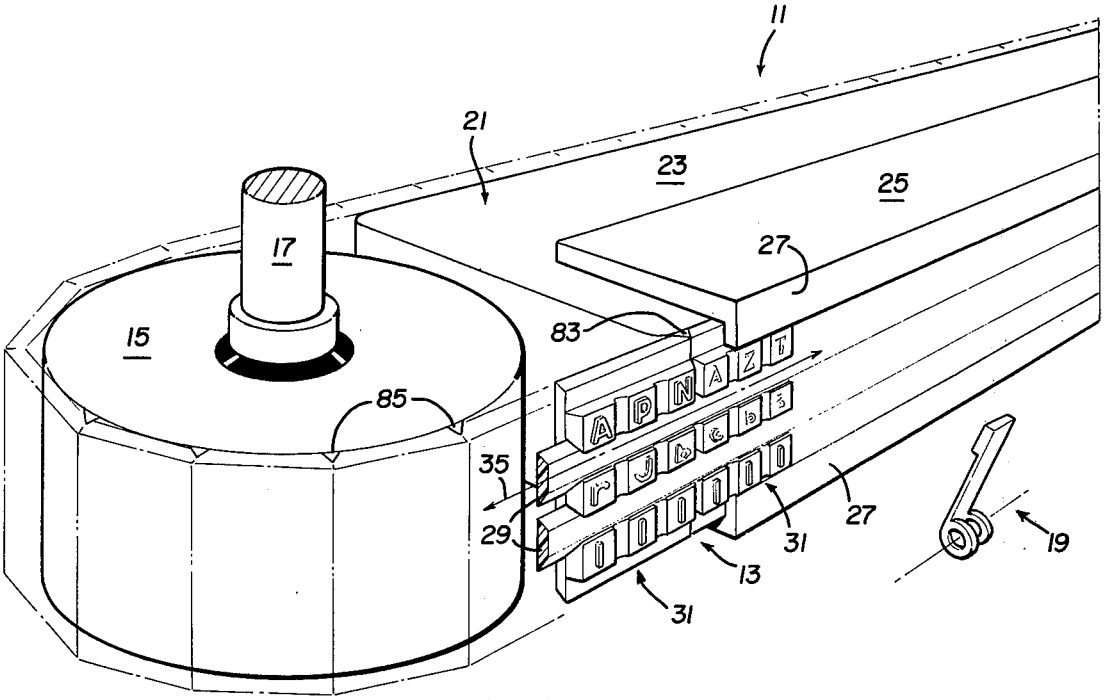
FIG. 1
FIG. 3
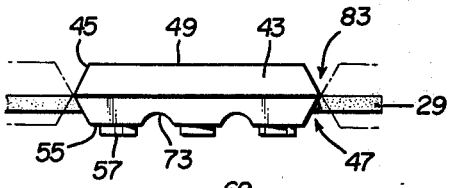
FIG. 4
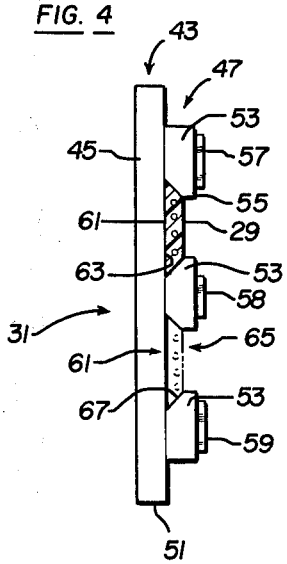
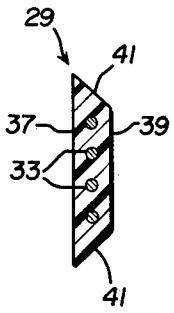
FIG. 5
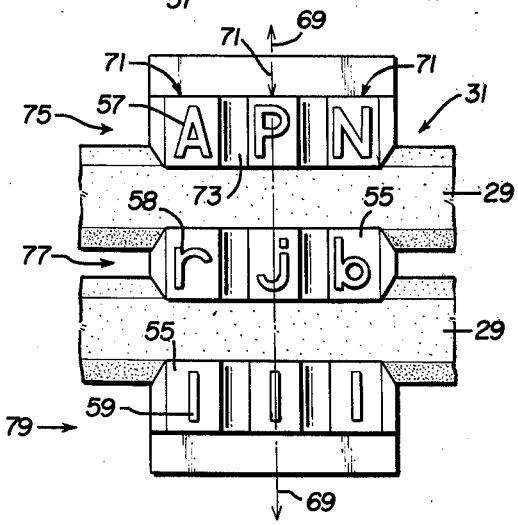
FIG. 2

TYPE CARRIER BELT FOR A PRINTER

BACKGROUND OF THE INVENTION

1. Field of the Invention

The present invention relates generally to printers, and more particularly to a type carrier belt formed as a continuous endless loop and having interchangeable or replaceable type segments.

2. Description of the Prior Art

Modern printing apparatus such as chain printers, band printers and the like employ a chain or type carrier belt which is rotated about two drums, spools or pulleys. The chain or belt includes a plurality of printing elements each provided with an alpha-numeric character, and each of the individual type elements will move past the print station one time during each revolution of the chain or belt loop.

It has become common in the industry to utilize endless metallic or stainless steel print belts having the characters and timing marks affixed thereon by either mechanical, chemical or electrical generation. When the ends of such metal belts are welded together to form a continuous endless loop, the belts may warp or become out of line during use thus rendering them ineffective.

It is also common to construct non-metallic type carrier belts or chains where the character-bearing elements or segments are affixed to the flexible non-metallic belts by mechanical or chemical bonding techniques.

Many of the prior art type carrier belts are expensive to produce since it is extremely difficult to technically control the shape and contour of the belt, especially where the belts are required to have special teeth, projections, holes or notches on the belt or band portion itself.

In most of todays printers, the type carrier belt is stretched over two pulleys or drums, one pulley being driven to cause the belt to be rotatably driven at a relatively high velocity and the other pulley being spring-loaded to maintain a constant pressure on the belt. Every time a given type segment passes over a pulley, severe internal stresses are induced or generated within the belt itself often resulting in metal fatigue or failure thereby reducing the useful life of the belt.

It has also been found that most of the endless metallic belts and some of the non-metallic belts are designed primarily for use with pulleys having an outside diameter of 5 inches or more. As the pulley diameter decreases, the internal stresses within the driven belt increase very rapidly. This means that pulley sizes smaller than 5 inches outside diameter are not economically sound. This means that most of the equipment used today employs rather large cabinets or housings encompassing the machine. Therefore, the belts now utilized have several problems which limit the useful life of the belt itself and also the life of the characters on the belt regardless of how the characters are applied thereto.

Whatever solutions have been adopted heretofore to extend the life of the belt or of the characters thereon, they have not been economically or technically sound and the problems still exist. It has been found that some type segments or printing elements on the belt tend to wear more rapidly than others. In most of the systems of the prior art, the entire band or chain had to be replaced even if only a small portion or a few type segments had become worn. While a few attempts have been made to provide interchangeable type segments which can be easily attached to and removed from the carrier belt, most of these belts have suffered from type alignment problems, the inability to retain a desired pitch, and the inability to place the individual type segments close enough together in a side-by-side manner so as to eliminate the play between adjacent carrier segments.

The United States Patents which are considered to represent the current state of the prior art are as follows: Helms, U.S. Pat. No. 3,845,711, issued Nov. 5, 1974; Migoux et al, U.S. Pat. No. 3,844,211, issued Oct. 29, 1974; Deproux, U.S. Pat. No. 3,838,765, issued Oct. 1, 1974; Funk et al, U.S. Pat. No. 3,835,771, issued Sept. 17, 1974; Pittis, U.S. Pat. No. 3,826,191, issued July 30, 1974; Bowers et al, U.S. Pat. No. 3,805,698, issued Apr. 23, 1974; Hansen et al, U.S. Pat. No. 3,774,531, issued Nov. 27, 1973; Perry et at, U.S. Pat. No. 3,745,918 issued July 17, 1973; Huntoon et al, U.S. Pat. No. 3,742,848, issued July 3, 1973; Bossi, U.S. Pat. No. 3,741,110, issued June 26, 1973; Picard, U.S. Pat. No. 3,724,371, issued Apr. 3, 1973; Niccolai, U.S. Pat. No. 3,719,139, issued Mar. 6, 1973; and Harrington, U.S. Pat. No. 3,665,852, issued May 30, 1972.

SUMMARY OF THE INVENTION

The present invention is directed to a type carrier belt formed into an endless loop comprising at least one elastomeric band having a trapazoidal cross-section and a plurality of interchangeable type segments snap-fitted onto the band in a side-by-side manner. Each of the type segments has a flat back surface forming the radially inner surface of the belt loop, tapered leading and trailing edge portions adapted to enable the belt loop to be rotatably driven, and an indicia-bearing outer peripheral portion. The outer portion includes at least two raised pedestal portions each having an outer surface parallel to the back surface and adapted to position the indicia thereon and a dove tail-shaped slot disposed between the pedestal portions for receivably retaining the elastomeric band therein. The indicia may be adapted to form alpha-numeric characters or to act as timing marks or both types may be employed on the different pedestals if desired. The individual segments are adapted to be easily attached to and removed from the elastomeric bands so as to be individually interchangeable and the band may include cords imbedded therein for strengthening the band and for controlling the elasticity thereof such that the band may be preloaded while snapping-on the individual type carrier segments so as to insure proper alignment in a side-by-side fashion and eliminate any play between adjacent type carrier segments.

It is a feature of the present invention to provide a low-cost, easy to make, easy to maintain type carrier belt for use in printing apparatus.

It is a further feature of the present invention to provide an improved flexible type carrier belt which is adapted to be used with drive wheels or pulleys having any specified diameter, including diameters of less than 5 inches.

It is still a further feature of the present invention to provide an endless loop, flexible type carrier belt which does not result in excessive heat being generated or in the type of belt fatigue common in the metallic belts of the prior art.

Still another feature of the present invention to provide a type carrier belt wherein the band or bands upon which the type segments are mounted are located at or centered about the geometric center of the type carrier segment thereby causing the type carrier belts to be very stable while in motion.

It is yet a further feature of this invention to provide a plurality of type carriers of a rectangular shape which can be easily replaced or interchanged on the bands of the belt without undue time and effort.

It is also a further feature of this invention to provide a type carrier belt which allows much latitude for carrier pitch because of the simplicity of the bands themselves which lack any type of teeth, projections, holes or notches in the band material itself thereby enabling the type carrier segments to be attached or located in a close side-by-side manner. A variety of type carrier lengths and widths may be used on the same bands as desired.

It is still another feature of the present invention that small gear-like teeth can be provided on the outside diameter of the drive pulley and the individual type segments can be provided with leading and trailing tapered edges so that the gear-like teeth will engage the bottom relief angle on both the leading and trailing edge portions of the type segments for driving the same and insuring a non-slip type of drive particularly while the character is in motion through the print station.

Another feature of the present invention is to provide a type carrier belt having a relatively small moment of inertia which allows the belt to print and track in a very harmonic manner thus eliminating excessive vibrations.

It is still a further feature of the present invention to provide an endless flexible type carrier belt which, because of the interchangeability and replaceability of the individual type segments, has a much longer life than the belts previously provided while maintaining the print quality, close side-by-side relationship of the segments, and proper character alignment as required in most printing operations.

It is still another feature of this invention to provide an endless type carrier belt wherein the elastomeric bands have a muting or dampening effect on sound and vibration.

Other advantages and meritorious features of the present invention will be more fully understood in the following detailed description of the drawings and the preferred embodiment, the appended claims and the drawings which are briefly described hereinbelow.

BRIEF DESCRIPTION OF THE DRAWINGS

FIG. 1 is a general fragmentary perspective view of the type carrier belt of the present invention used in a belt type printer;

FIG. 2 is a plan view of a fragmentary portion of the type carrier belt of the present invention showing a portion of the elastomeric bands and a single multi-character carrier segment attached thereto;

FIG. 3 is a top view of the carrier segment of FIG. 2;

FIG. 4 is an end view of the carrier segment of FIG. 2;

FIG. 5 is a cross-sectional view of one of the elastomeric bands of this invention;

DESCRIPTION OF THE PREFERRED EMBODIMENT

Figure 6:
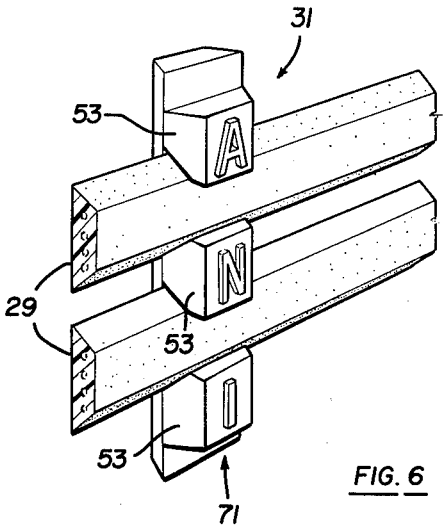
FIG. 6 is a fragmentary perspective view of an alternate embodiment of the type carrier belt of the present invention.

Referring to FIG. 1 of the drawing, the reference numeral 11 generally designates a print apparatus utilizing the endless loop type carrier belt 13 of the present invention. The belt 13 is entrained about a pair of drums, rollers, or pulleys 15, only one of which is shown in FIG. 1. The pulley 15 may be driven by a motor, not shown but conventionally known, via pulley drive shaft 17. The reference numeral 19 represents a hammer assembly or printing station which the endless belt 13 is transported or rotatably driven past. A second pulley, which is not shown, could be a typical spring-loaded pulley designed to maintain a constant pressure or load upon the print belt 13.

The print apparatus 11 of FIG. 1 also includes adjacent the hammer assembly or printing station 19, a guide means 21. The guide means 21 is shown as including a backup or support block 23 and a guide portion 25. The guide portion 25 includes a pair of inturned lip portions 27 which are spaced from the outer surface of the support block 23 to form a space in which the print belt 13 is guideably received for being slideably driven past the print station 19.

The type carrier belt of the present invention and the drive pulleys 15 therefore could be enclosed within a single type cartridge, which is not shown but generally known, and the cartridge could be adapted to include the pulleys 15, the type carrier belt 13, and the guide assembly 21 if desired.

The type carrier belt 13 of FIG. 1 includes a pair of elastomeric bands 29 to which individual carrier segments 31 can be snap-fitted for easy attachment to or removal from the bands 29 thereby rendering the carrier elements 31 interchangeable and replaceable.

The elastomeric bands 29 are formed into a continuous endless loop. Each of the bands 29 is made from a suitable elastomeric material and the term is used in its generic since to include such materials as natural or synthetic rubber, vinyl plastic, urethane, and any other type of generally resilient plastic material commonly referred to as elastomeric which would be suitable to this use. The bands 29 may include a plurality of strands or cords 33 which tend to reinforce the bands 29 and to control the elasticity thereof so that the bands 29 may be snap-fitted onto the segments 31 and so that the bands may be pre-loaded or stretched while snapping on the carrier segments 31 so as to permit no play therebetween. The cords or strands 33 may be made from any suitable material, such as metal, plastics, fiberglass, nylon, or fabric or any other suitable material or fabrication having sufficient strength to prevent stretching of the belt so as to control its elasticity.

Each band 29 has a longitudinal axis 35 aligned with its direction of movement and a trapezoidal cross-section. The trapezoidal cross-section of the elastomeric band 29 is best shown in FIG. 5. The band 29 has a wider-dimensioned trapezoidal base 37, a lesser-dimensioned trapezoidal top 39 which is parallel to the trapezoidal base 37, and a pair of sloped sides 41 connecting the top 39 to the base 37.

The carrier segments 31 are generally formed as a unitary piece from a relatively hard material such as steel, carbide, plastic, or some type of steel alloy commonly used in making printing elements. The selection of these materials is conventionally known within the printing art and form no part of the present invention.

As shown in FIGS. 2, 3 and 4, the carrier segment 31 includes a base portion 43, tapered leaving and trailing edge portions 45, and an indicia-bearing outer peripheral portion or front portion 47. The base portion 43 has a substantially planar inwardly facing back surface 49 and top and bottom generally planar edge surfaces 51, the plane of which is generally perpendicular to the plane of the back surface 49.

The front portion 47 is on the opposite side of the base portion 43 from the rear surface 49 and includes three pads or pedestal portions 53 raised outwardly from the base portion 43. Each of the pedestal portions 53 includes an indicia-bearing outer peripheral surface or face 55 which supports an indicia means 57 thereon. The indicia means 57 may be, for example, a type face or configuration for forming an alpha-numeric character as indicated by the reference numeral 58 or, in the alternative, the indicia means 57 may serve or act as a timing mark as indicated by the reference numeral 59. The term character as used herein includes the alphabetical characters, numbers, and symbols of any type normally found on typewriters, printers and the like.

The front portion 47 of the carrier segment 31 also includes a pair of dove tail-shaped slots or trapezoidal slots 61 which are disposed between adjacent pedestal portions 53. Each of the slots 61 includes a slot bottom 63 which is a substantially planar surface of the base portion 43 opposite the back face 49. The slot bottom 63 is disposed against the trapezoidal base 37 of the band 29 while the trapezoidal top 37 of the elastomeric band 29 is disposed facing the slot opening 65. The slot opening 65 is disposed between adjacent pedestal portions 53 and is dimensionally smaller than the slot bottom 63. The sides of the slot opening 65 are connected to the slot bottom 63 by outwardly sloping slot walls 67 which may form a portion of the walls of the pedestals 53. Each slot 61 is dimensioned slightly smaller than the trapezoidal crosssection of the elastomeric band 29 so that when the band 29 is inserted through the slot opening 65 and snap-fitted into the slot 61, its inherent resiliency causes it to expand to bear against the slot bottom 63 and the slot walls 67 to be resiliently retained within the slot 61. Since the elastomeric band 29 is resilient, the carrier segment 31 may be attached to or removed from the bands 29 as desired to render the segments 31 replaceable or interchangeable.

As seen in FIG. 4, the ends of the slots 61 along the longitudinal axis 35 are open while the sides 67 of the slot 61 along an axis transverse thereto, the segment axis 69, are tapered and form at least a portion of the walls of the pedestal portions 53.

The pedestal portions 53 are aligned to form first, second and third columns 71 which are parallel to the alignment or segment axis 69. In the embodiment of FIG. 2, each of the columns 71 is parallel to the other; and each column 71 includes three pedestal portions 53 and therefore three indicia-bearing faces 55. In general, each of the pedestals 53 of each of the columns 71 is integrally coupled to the base portion 43 so that a single carrier segment 31 may include *n* columns where *n* is any positive interger greater than zero and each of the columns 71 may include any number *m*, where *m* is any positive integer greater than one, of pedestal portions 53 aligned parallel to the segment axis 69.

Each of the columns 71 are separate from the other and each is separated by a vertical slot 73 aligned with the segment axis 69. Since each of the pedestals 53 in a column 71 are separated from the other by a belt slot 61 and the elastomeric belt 29 inserted therein, we may also refer to first, second and third rows 75, 77 and 79 respectfully of pedestal portions or pads 53. In the embodiment of FIG. 2, the segment 31 includes three separate columns 71 of aligned pad portions 53 and the indicia-bearing faces 55 of the pedestal portions 53 of the first row 75 include indicia means 57 adapted to form alpha-numeric characters 58. Similarly, the second row 77 of pedestal portions 53 have their indicia means 57 adapted to form alpha-numeric characters 58, but the third row 79 of pedestals 53 has the indicia-bearing or carrying surface 55 of each of the pedestals 53 carrying an indicia means 57 which is adapted to serve or function as a timing mark 59.

FIG. 6 illustrates an alternate embodiment of the type carrier belt 13 of the present invention wherein two elastomeric bands have attached thereto a plurality of carrier segments 31 but the carrier segment 31 includes only a single column 71 of pedestal portions 53 align parallel to the segment axis 69. It may be noted that the pair of elastomeric belts 29 are located along the segment axis 69 so that they are equally spaced on either side of the geometric center of the segment 31 for improved stability.

Figure 7:
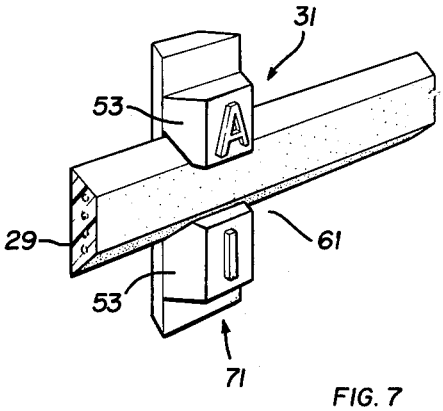
FIG. 7 is a fragmentary perspective view of another alternate embodiment of the type carrier belt of the present invention.
Figure 9:
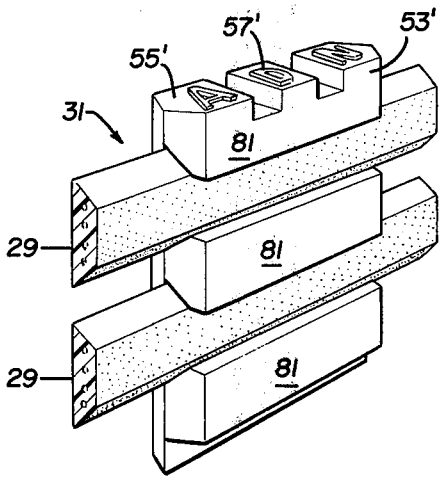
FIG. 9 is a fragmentary perspective view of yet another embodiment of the type carrier belt of this invention.

FIG. 7 illustrates another embodiment of the type carrier belt 13 of the present invention wherein the continuous loop belt 13 is formed with a single elastomeric belt 29 and a plurality of carrier segments 31 each having a single column including only a first and a second pedestal portion 53 on either side of the band-engaging slot 61. While the indicia means 57 of the upper pedestal 53 is illustrated as a means for forming an alpha-numeric character and the indicia means 57 of the lower pedestal 53 is shown as forming a timing mark, it will be understood that the order could be reversed, the timing mark could be eliminated, or the character-forming means could be situated on the upper edge of the segment 31 as illustrated in FIG. 9. Similarly, the segment 31 could include *n* Columns 71 of two pedestals 53 each.

Figure 8:
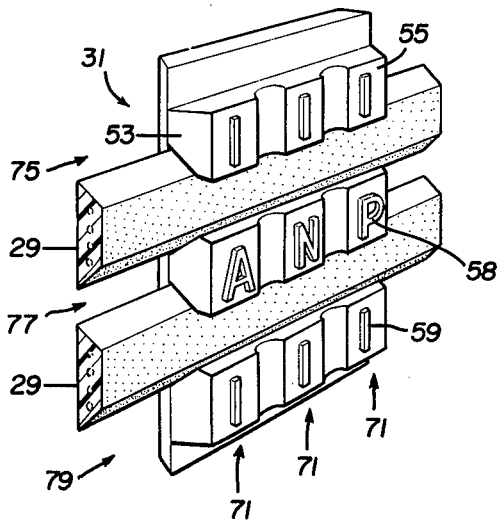
FIG. 8 is a fragmentary perspective view of still another alternate embodiment of the type carrier belt of this invention.

The illustration of FIG. 8 shows still another embodiment of the type carrying belt or chain 13 of the present invention wherein a single integral carrier segment 31 is attached to a pair of elastomeric bands 29. The segment 31 includes three separate and distinct vertical columns 71 of pedestals 53 and each of the columns has three of the pedestal portions 53 arranged in a vertical Column 71 aligned with the segment axis 69. In the embodiment of FIG. 8, the middle row 77 of pedestal portions 53 each has its indicia-bearing face 55 mounting an indicia means 57 adapted for forming alpha-numerical characters 58 while the upper row 75 and lower row 79 of pedestal portions 53 have their indicia-carrying face 55 mounting indicia means 57 serving as timing marks 59. From these embodiments, it will be seen that any number of columns 71 of pedestal portions 53 may be contained on a given carrier segment and any number greater than one of pedestal portions 53 may be contained within each of the columns 71. Similarly, it will be observed that any of the rows of pedestals may carry timing marks or alphanumeric characters as required for the needs of the particular application.

FIG. 9 represents yet another alternate embodiment of the continuous loop type-carrying belt 13 of the present invention wherein a plurality of carrier segments 31 are attached to one or more elastomeric belts 29 but the pedestal portions 53' are located on the upper edge 51 of the segment 31 such that their upper indicia-bearing surface 55' positions indicia means 57' thereon. The raised slot-forming portions 81 may, if desired, be provided with timing marks 59 or, in the alternative, may be blank. Similarly, it will be understood that a much narrower single column 71 could be utilized in the embodiment of FIG. 9 with an alphanumeric character forming means 58 on its upper end 55' or, a shorter one-elastomeric belt 29 version, as illustrated in FIG. 7, may be employed which has the alpha-numeric character forming means 57' on the upper surface 55' of the segment 31. The basic embodiments disclosed herein should make other variations readily apparent to those skilled in the art given the teachings contained herein.

As shown in FIG. 1, the carrier segments 31 making up the type carrier belt 13 are shown in phantom lines about the drive pulley 15. It will be seen that the tapered trailing edge of the character segment 31 which has emerged from the guide means 21 and the leading edge of the carrier segment 31 still housed within the guide means 21 meet to form a V-shaped notch or relief angle 83 which cuts into the plane formed by the back surface 49 of the base 43 of the segments 31.

Similarly, the drive pulley 15 may be provided with a plurality of uniformly spaced, gear-like teeth 85 which are adapted to engage the spaced notches 81 between adjacent carrier segments 31 to positively drive the type-carrying belt 13 without slippage. It will be obvious that if one or two column carrier segments 31 are utilized, the gear-like teeth would be spaced closer together and even smaller drive pulleys 15 could be used. Likewise, if a larger diameter drive pulley 15 were used, a type carrier belt could be formed from even larger segments 31 having more than three columns 71 thereon and the gear-like teeth 85 would be positioned even further apart.

It will be noted that the elastomeric bands 29 do not directly contact the drive pulley 15 thereby preventing wear and damage to the bands 29. The innermost surface or trapezoidal base 37 of the bands 29 rests against the front face of the base portion 43 of the segment 31 which acts as the bottom wall 63 of the slot 61 thereby spacing the bands 29 from the drive pulley 15 by the thickness of the base portion 43. Since the individual carrier segments 31 are interchangeable and replaceable with ease, the belt 13 has an extremely long life since the elastomeric bands 29 are not subject to a great degree of wear or fatigue and the carrier segments 31 may be replaced individually. This results in a relatively inexpensive and easy to maintain and repair print belt which can be used in any of the chain or belt printers or which can be readily inserted into a print belt cartridge as known in the art. Similarly, the present invention could be mounted over drums or small cylinders to form print drums or heads.

With this detailed description of the specific apparatus used to illustrate the present invention and the operation thereof, it will be obvious to those skilled in the art that various modifications can be made in the illustrated embodiments without departing from the spirit and scope of the present invention which is limited only by the appended claims.

I claim:

1. A type carrier assembly formed into an endless loop for use in a printing apparatus having means for rotatably driving said assembly past a printing station, said type carrier assembly comprising: a flexible elastomeric band having a trapezoidal non-rectangular cross-section, said band including means imbedded therein for reinforcing said band and controlling the elasticity thereof; and a plurality of type carrier segments disposed in a predetermined side-by-side relationship and in close proximity to adjacent segments, each of said segments including (1) a substantially planar base portion having one surface forming the interior-facing surface of said endless loop for engaging said rotatable driving means, (2) means for mounting an indicia-carrying face on a second surface of said base portion, and (3) means forming a dove tail-like slot in the surface of said base portion opposite said one surface for engagably receiving and resiliently retaining said elastomeric band therein.

2. The type carrier assembly of claim 1 further characterized in that said elastomeric band has an inner surface and an outer surface, the inner surface of said band being disposed within said slot while the outer surface of said band is substantially exposed.

3. The type carrier assembly of claim 2 further characterized in that said band has a longitudinal axis and said trapezoidal cross-section includes a base having a first dimension, a top having a lessor dimension and sides tapering from the base to the top, the base of said trapezoidal cross-section forming the inner surface of the band which is disposed within said dove tail-like slot in contact with the base portion of said segment, the top of said trapezoidal cross-section forming the outer surface of the band, and the sides of said trapezoidal cross-section resiliently contacting the walls of said slot to retain said band therein such that substantially none of the band contacts said rotatable driving means.

4. The type carrier assembly of claim 1 further characterized in that said second surface of said base portion upon which said indicia-carrying face is mounted corresponds to an edge surface of said base portion which is substantially normal to the plane of said one surface.

5. The type carrier assembly of claim 1 further characterized in that said second surface of said base portion upon which said indicia-carrying face is mounted corresponds to said opposite surface which is substantially parallel to said one surface.

6. The type carrier assembly of claim 5 further characterized in that said mounting means includes a first pad portion raised from said base portion and disposed on one side of said slot for mounting a first indicia-carrying face and a second pad portion raised from said base portion and disposed on the opposite side of said slot for mounting a second indicia-carrying face.

7. The type carrier assembly of claim 6 further characterized in that said first indicia-carrying face forms an alpha-numeric character while said second indicia-carrying face carries a timing mark.

8. The type carrier assembly of claim 6 further characterized in that the wall of said first pad portion which faces said slot forms at least a portion of one of the sloping walls thereof and the wall of said second pad portion which faces said slot forms at least a portion of the corresponding opposite sloped wall thereof.

9. The type carrier assembly of claim 1 further characterized in that the mounting means of each of said type carrier segments mounts a plurality of said indicia-carrying faces.

10. The type carrier assembly of claim 1 further characterized in that said assembly includes a second flexible elastomeric band having a trapezoidal cross-section, said second band including means imbedded therein for reinforcing said second band and controlling the elasticity thereof, said second band being spaced from said first band such that the longitudinal axes of said first and second bands are parallel, each of said type carrier segments also including a second means forming a dove tail-like slot in the surface of said base portion opposite said one surface for engagably receiving and resiliently retaining said second band therein, said second slot being spacially separated from said first slot and parallel thereto.

11. The type carrier assembly of claim 10 further characterized in that said mounting means includes first, second and third pedestal portions aligned in a column such that the axis of alignment is substantially normal to the longitudinal axis of said first and second bands, each of said pedestal portions being raised from said base portion and each includes a generally rectangular, substantially planar, outwardly facing surface parallel to said one surface for mounting said indicia-carrying face, said pedestal portions being spacially separated from one another by said slots, and further characterized in that said first slot-forming means includes a first wall of said first pedestal portion tapering from adjacent said first planar outer surface towards said base portion, a second wall of said second pedestal portion tapering from adjacent said second planar outer surface towards said base portion, and a generally planar slot bottom substantially parallel to said one surface connecting said walls at said base portion, said first and second walls tapering in opposite directions along said alignment axis such that the distance between said first and second planar outer surfaces measured along said alignment axis is less than the distance between the wall-base portion junctions whereby said slot bottom is disposed against the greater dimensioned trapazoidal base of said first band which is resiliently retained within said first slot by the wedging action of the sloped trapezoidal sides of said first band against said first and second tapered walls, and in that said second slot-forming means includes a third wall of said third pedestal portion tapering from adjacent said planar outer surface towards said base portion, a fourth wall of said second pedestal opposite said second wall, said fourth wall tapering from adjacent said planar outer surface towards said base portion, and a second generally planar slot bottom substantially parallel to said one surface connecting said third and fourth walls at said base portion, said third and fourth walls tapering in opposite directions along said alignment axis such that the distance between said second and third planar outer surfaces measured along said alignment axis is less than the distance between the wall-base portion junctions whereby said second slot bottom is disposed against the greater dimensioned trapezoidal base of said second band which is resiliently retained within said second slot by the wedging action of the sloped trapezoidal sides of said second band against said third and fourth tapered walls.

12. The type carrier assembly of claim 11 further characterized in that each of said carrier segments includes only a single column of said first, second and third pedestal portions.

13. The type carrier assembly of claim 11 further characterized in that each of said carrier segments includes three separate columns of aligned first, second and third pedestal portions and the alignment axes of each of the columns are parallel.

14. The type carrier assembly of claim 11 further characterized in that each of said carrier segments includes $n$ separate columns of pedestals, where $n$ is any positive integer, the axis of each of said $n$ columns being parallel and all of the pedestal portions of said $n$ columns being integral with a single base portion.

15. The type carrier assembly of claim 11 further characterized in that at least one of said indicia-carrying faces carries a timing mark.

16. The type carrier assembly of claim 11 further characterized in that said indicia-carrying faces of said first and second pedestal portions carry alpha-numeric character-forming means and the indicia-carrying face of said third pedestal portion carries a timing mark.

17. The type carrier assembly of claim 11 further characterized in that said indicia-carrying faces of said first and third pedestal portions carry timing marks and the indicia-carrying face of said second pedestal portion carries an alpha-numeric character-forming means.

18. The type carrier assembly of claim 10 further characterized in that the imbedded means of said first and second bands controls the elasticity thereof such that said bands may be stretched while snapping said carrier segments thereon so as to eliminate play between adjacent segments and wherein said first and second slots are positioned such that said first and second bands engage said first and second slots proximate the geometric center of the carrier segments for improved stability.

19. The type carrier assembly of claim 1 further characterized in that both the leading and trailing edges of said base portion includes a portion tapered inwardly toward said one surface which engages said driving means for reducing slippage between said driving means and said type carrier assembly.

20. The type carrier assembly of claim 1 wherein said driving means includes a drive pulley, said drive pulley having a plurality of small gear-like teeth about the periphery thereof and wherein the leading and trailing edges of said base portions of said segments include a portion tapered inwardly such that the distance between the leading and trailing edges of said one surface measured parallel to the longitudinal axis of said band is less than the distance between the leading and trailing edges adjacent thereto, said teeth being adapted to engage the tapered portions of the leading and trailing edges to prevent slippage and rotatably drive said type carrier assembly.

21. In a printing apparatus wherein a type carrying belt is moved relative to a printing station and a hammer assembly may be selectively actuated to provide selective printing of characters on a print media, said belt being formed as a continuous endless loop entrained about a pair of pulleys, at least one of said pulleys being rotatably driven by a motor to effect said movement and includes a plurality of relatively small gear-like teeth spaced about the periphery thereof, and a guide means secured to the printer to slideably receive and guide said type carrying belt as it is driven past said print station, an improved type carrying belt comprising: a pair of elastomeric bands each formed into an endless loop each having an inner and an outer surface, each band having a longitudinal axis aligned with the direction of motion thereof and a trapazoidal cross-section, the trapezoidal base of each of said bands forming the inner surface of the band loop and the lesser dimensioned trapezoidal top surface of each of said bands forming the outer peripheral surface of said band loop; and a plurality of type carrying segments adapted to be snapfitted onto said bands so that said segments can be selectively attached to and removed from said bands, said segments being arranged in a side-by-side manner and each is a single integral piece having a segment axis normal to said longitudinal axis, each of said segment axes being parallel to one another when said segments are attached to said bands, each of said segments including (1) a segment base portion having a generally planar inwardly facing back surface, the back surfaces of all of said attached segments forming the inner surface of said continuous endless loop formed by said type carrying belt, (2) a type carrying front portion opposite said back surface, and (3) edge portions tapering inwardly toward said back surface on the leading and trailing edges of said segment, said edge portions being parallel to said segment axis, the tapered edge portions of adjacent segments forming a notch adapted to be engaged by the gear-like teeth of said at least one pulley for rotatably driving said type carrying belt, said type carrying front portion including a pair of spaced trapezoidally shaped slots aligned parallel to said longitudinal axis and disposed on either side of the geometric center of said segment measured along said segment axis so as to be centered with respect thereto, each of said slots being adapted to receivably retain one of said bands therein in a snapfit manner such that bands are spacially separated from said pulley by said segment base portions, said front portion also including pedestal portions rising away from said segment base portion and disposed along said segment axis on the outside of both of said slots and therebetween, each of said pedestal portions having a substantially planar forward surface adapted to mount indicia means.

22. The improved printing apparatus of claim 21 further characterized in that each of said segments includes three of said pedestal portions aligned in a single column along said segment axis and at least one of the substantially planar forward surfaces mounts an indicia means for forming an alpha-numeric character.

23. The improved printing apparatus of claim 22 further characterized in that at least one of the substantially planar forward surfaces mounts an indicia means adapted to function as a timing mark.

24. The improved printing apparatus of claim 21 further characterized in that each of said segments includes at least three distinct columns of pedestal portions, each of said columns having three pedestal portions aligned parallel to said segment axis, and at least one of the pedestal portions of each of said columns has its forward surface mounting an indicia means for forming an alphanumeric character.

25. The improved printing apparatus of claim 24 further characterized in that at least one of the pedestal portions in each of said three columns has its forward face mounting an indicia means adapted to serve as a timing mark.

26. The improved printing apparatus of claim 21 wherein said guide means includes upper and lower inturned lips for guideably retaining said type carrying belt for slideable motion therein and further characterized in that each of said segments includes upper and lower L-shaped portions adapted to be engaged by said upper and lower inturned lips of said guide means.

27. The improved printing apparatus of claim 26 further characterized in that the upper and lower edges of said segment base portion which are parallel to said longitudinal axis and normal to said tapered edge portions are substantially planar, the plane being normal to said back surface, and each of said L-shaped portions includes a substantially planar first portion parallel to said back surface and a second portion at least part of which is formed by the outermost wall of the outermost pedestal portion along said segment axis.

28. The improved printing apparatus of claim 21 further characterized in that said elastomeric bands include cord-like means imbedded therein for strengthening the bands and controlling the elasticity thereof such that said belts are adpated to be stretched to preload same so that said segments may be snapped on with substantially no play existing between segments when the belt is released.

29. The improved printing apparatus of claim 21 further characterized in that said segments are generally rectangular in shape, the dimension measured along said segment axis being greater than the dimension measured along said longitudinal axis.

30. A type carrier belt formed into an endless loop having an inner surface and an outer printing surface comprising at least one elastomeric band having a longitudinal axis aligned with the direction of movement thereof and a trapezoidal cross-section, and a plurality of generally rectangular type segments each having a segment axis transverse to said longitudinal axis and each segment including (1) a base having a relatively flat back surface, the back surfaces of said plurality of segments forming said inner belt surface, (2) tapered leading and trailing edge portions sloping inwardly toward said back surface for enabling said segments to be driveably engaged by a rotating drive means, (3) first and second pedestal portions on the side of said base opposite said back surface, each of said pedestal portions having an outer loop face substantially parallel to said back surface and adapted to carry indicia means thereon, and (4) slot means disposed between said pedestal portions having its relatively narrow opening facing away from said base, its relatively wider bottom being formed from the front surface of said base, and sloped side walls on opposite sides of said slot along said segment axis connecting said bottom and said opening such that said slot is adapted to receivably retain said band therein while permitting said segments to be attached or removed as desired.

31. The type carrier belt of claim 30 wherein said slot means includes open ends along said longitudinal axis, and wherein the cross-sectional configuration of said slot is trapezoidal but is dimensioned slightly smaller than the trapezoidal cross-section of said band so that said band may be snap-fitted into said slot and retained therein by the inherent resiliency of said elastomeric band.

32. The type carrier belt of claim 30 further characterized in that said first and second pedestal portions are aligned in a column parallel to said segment axis and wherein said segement includes a plurality of such columns, each column being integral with a single segement base.

33. The type carrier belt of claim 32 wherein the indicia means of one of said pedestal portions is adapted to form a character and the indicia means of the other of said pedestal portions is adapted to act as a timing mark.

34. The type carrier belt of claim 30 further characterized in that said carrier belt includes a second elastomeric band having a trapezoidal cross-section and each of said segments includes a second slot means spaced along said segment axis from said first slot means and adapted to receivably retain said second band and a third pedestal portion disposed in a column with said first and second pedestal portions and parallel to said segment axis such that one of said pedestal portions is disposed on either side of the two slot means.

35. The type carrier belt of claim 34 further characterized in that each of said segments includes a plurality of said aligned columns of pedestal portions, each of said columns being parallel to said segment axis and each being integral with a common segment base.

36. The type carrier belt of claim 35 further characterized in that the indicia means of at least one of the pedestal portions in each of said columns is adapted to form a character.

37. The type carrier belt of claim 35 further characterized in that the indicia means of at least one of the pedestal portions in each of said columns is adapted to serve as a timing mark.

* * * * *